US009358664B2

(12) United States Patent
Ikuta

(10) Patent No.: US 9,358,664 B2
(45) Date of Patent: Jun. 7, 2016

(54) GRINDER

(71) Applicant: MAKITA CORPORATION, Anjo-shi, Aichi (JP)

(72) Inventor: Hiroki Ikuta, Anjo (JP)

(73) Assignee: MAKITA CORPORATION, Anjo (JP)

( * ) Notice: Subject to any disclaimer, the term of this patent is extended or adjusted under 35 U.S.C. 154(b) by 266 days.

(21) Appl. No.: 13/710,772

(22) Filed: Dec. 11, 2012

(65) Prior Publication Data

US 2013/0157550 A1 Jun. 20, 2013

(30) Foreign Application Priority Data

Dec. 14, 2011 (JP) ..... 2011-273302
Nov. 30, 2012 (JP) ..... 2012-262330

(51) Int. Cl.
*B24B 23/00* (2006.01)
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 55/052; B24B 55/05; B24B 23/02
USPC ..... 451/451, 452, 453, 455, 357, 358, 359; 83/571–573; 403/104, 106–108
See application file for complete search history.

(56) References Cited

U.S. PATENT DOCUMENTS 5,031,325 A 7/1991 Walter et al.
5,386,667 A * 2/1995 Hausslein et al. ..... 451/344
5,766,062 A * 6/1998 Edling ..... 451/451
7,063,606 B2 * 6/2006 Stierle et al. ..... 451/359
2008/0153404 A1 6/2008 Schmidberger-Brinek et al.
2008/0280549 A1 * 11/2008 Sulea et al. ..... 451/451
2009/0130961 A1 * 5/2009 Boeck et al. ..... 451/344
2010/0178857 A1 * 7/2010 Esenwein ..... 451/359
2012/0190280 A1 7/2012 Esenwein

FOREIGN PATENT DOCUMENTS

DE 10 2007 052 685 A1 5/2009
DE 10 2009 028 404 A1 2/2011

(Continued)

OTHER PUBLICATIONS

Extended European Search Report issued in European Patent Application No. 12196369.8 on Nov. 13, 2013.
Jul. 2, 2014 Office Action issued in European Application No. 12 196 369.8.
Feb. 2, 2015 Office Action issued in European Patent No. 12 196 369.8.

(Continued)

*Primary Examiner* — Timothy V Eley
*Assistant Examiner* — J Stephen Taylor
(74) *Attorney, Agent, or Firm* — Oliff PLC

(57) ABSTRACT

A grinder includes a body having an annular portion, a wheel cover which is attachable to the annular portion, and a wheel cover holding member which holds the wheel cover. The wheel cover has a cylindrical portion which is attachable to the annular portion. The wheel cover holding member has a slide member and a pressing portion which moves the slide member. The pressing portion switches a state between an engagement state in which the slide member is engaged with the cylindrical portion and a disengagement state in which the slide member is disengaged with the cylindrical portion by moving the slide member. The pressing member moves on a second line which is parallelly offset from a first line passing the center of the annular portion in a predetermined direction.

19 Claims, 14 Drawing Sheets

(56) References Cited

FOREIGN PATENT DOCUMENTS

| | | | |
|---|---|---|---|
| JP | H10-76481 | A | 3/1998 |
| WO | WO 2004/087377 | A1 | 10/2004 |
| WO | WO 2009/059838 | A1 | 5/2009 |

OTHER PUBLICATIONS

Mar. 18, 2016 Office Action issued in Japanese Application No. 2012-262330.

* cited by examiner

GRINDER

CROSS REFERENCE TO RELATED APPLICATION

The present application claims priority from Japanese Patent Applications No. 2011-273302 filed on Dec. 14, 2011 and Japanese Patent Application No. 2012-262330 filed on Nov. 30, 2012, the disclosure of which is incorporated herein by reference in their entirety.

FIELD OF THE INVENTION

The invention relates to a grinder having a wheel cover.

BACKGROUND OF THE INVENTION

PCT International Publication No. WO 2004/087377 discloses a portable power grinder which has a grinding wheel safety guard. The grinding wheel safety guard is held at a number of pre-selected angular positions by a manually operable safety guard arresting device. The arresting device has a lock slide which is movably guided in a longitudinal direction of a housing and is provided so as to head toward an output shaft.

SUMMARY OF THE INVENTION

Problem to be Solved by the Invention

The arresting device of the grinder described in WO 2004/087377 is provided to move linearly between an arresting position and a releasing position in a radial direction which passes a center axis of the output shaft which is disposed at a center of the safety guard. Namely, since it is necessary that a movable part of the arresting device is provided at an extended area from a diameter in a direction of the diameter of the safety guard, the grinder becomes larger due to an arrangement of the arresting device.

An object of the invention is, in consideration of the above described problem, to provide a rational technique with respect to an attaching construction of a wheel cover.

Means for Solving the Problem

Above-mentioned object is achieved by the claimed invention. According to a preferable aspect of the invention, a grinder comprises a body which has a collar, a wheel cover which is attachable to the collar, and a holding member which is adapted to hold the wheel cover fixedly to the collar. The wheel cover has an annular shaped attachment portion which is attachable to the collar. The holding member has an engagement portion and an engagement portion operating member which moves the engagement portion, the engagement portion being engageable with the attachment portion. The engagement portion operating member switches a state between an engagement state in which the attachment portion and the engagement portion are engaged to each other and a disengagement state in which the attachment portion and the engagement portion are disengaged to each other by moving the engagement portion. Further, the engagement portion operating member moves on a second line which is parallelly offset from a first line passing a center of the attachment portion and extending in a predetermined direction.

According to this aspect, since the engagement portion operating member is moved linearly on the second line which is parallelly offset from the first line, in comparison with a construction in which the engagement portion operating member is moved linearly on the first line, a size of a wheel cover holding mechanism including the wheel cover and the holding member is downsized. Namely, in case that the engagement portion operating member is moved linearly on the first line, a length of a wheel cover holding mechanism in a predetermined direction in which the first line extends is equal to total length of an outside diameter of the attachment portion and a length of a movable region of the engagement portion operating member. On the other hand, in this invention, since the engagement portion operating member is moved linearly on the second line which is parallelly offset from the first line, a length of the wheel cover holding mechanism in the predetermined direction is equal to a length of the longer component between the engagement portion operating member and the outside diameter of the attachment portion. Accordingly, the length in the predetermined direction is shortened. Because of such arrangement of the wheel cover holding mechanism, the whole size of the grinder is downsized.

According to a further preferable aspect of the invention, the engagement portion is engageable with an outer edge of the attachment portion, the outer edge being located on a line passing a central region of the attachment portion and being parallel to the first line.

According to this aspect, in case that a moving direction of the engagement portion operating member is in conformity with a moving direction of the engagement portion, the engagement portion can engage with a part of the attachment portion where a line crosses the attachment portion, the line passing the center region of the attachment portion and being parallel to the moving direction of the engagement portion operating member. As a result, the engagement portion and the attachment portion are engaged steadily to each other. In other words, because the moving direction of the engagement portion comes close to a normal direction of the attachment portion, the engagement portion and the attachment portion are engaged steadily to each other.

According to a further preferable aspect of the invention, the engagement portion is adapted to cancel an engagement with attachment portion by moving to inside of the attachment portion.

According to this aspect, since the engagement portion moves to inside of the attachment portion, in comparison with a structure in which the engagement portion moves to outside of the attachment portion, an outline of the grinder is downsized.

According to a further preferable aspect of the invention, the engagement portion has a plurality of engagement elements which are respectively engageable with the attachment portion.

According to this aspect, because the engagement portion is provided with a plurality of engagement elements, the attachment portion is held by said plurality of engagement elements. Accordingly, the attachment portion is held steadily.

According to a further preferable aspect of the invention, the engagement portion has a plurality of engagement elements which are respectively engageable with the attachment portion. Further, at least one engagement element is adapted to cancel an engagement with the attachment portion by moving to inside of the attachment portion, and the other engagement element is adapted to cancel an engagement with the attachment portion by moving to outside of the attachment portion.

According to this aspect, said plurality of engagement elements are moved respectively to inside and outside of the attachment portion by moving the engagement portion in only one direction against the attachment portion. Namely, canceling the engagement between the engagement portion and the attachment portion is easily accomplished.

According to a further preferable aspect of the invention, the engagement portion operating portion is located at a tangent line region which corresponds to a tangent line parallel to the first line, and the engagement portion operating portion moves linearly along the tangent line.

According to this aspect, the engagement portion operating member is arranged at the tangent line region which is close to the tangent line being parallelly offset from the first line. Therefore, a length of the attachment portion in the tangent region in the moving direction of the engagement portion operating member is minimized. Accordingly, a length of the wheel cover holding mechanism in a direction parallel to the first line is minimized.

According to a further preferable aspect of the invention, said plurality of engagement elements are arranged approximately symmetrically to each other with respect to the center of the attachment portion.

In case that a plurality of engagement elements are arranged unsymmetrically to each other with respect to the center of the attachment portion, a centroid of said plurality of engagement elements does not match the center of the attachment portion. Therefore, the holding member holds the attachment portion eccentrically. However, according to this aspect, because said plurality of engagement elements are arranged approximately symmetrically to each other with respect to the center of the attachment portion, the holding member holds the attachment portion steadily.

According to a further preferable aspect of the invention, the wheel cover is selectively located at one rotational position from a plurality of rotational positions which are different to each other, and the wheel cover is attachable to the collar in a selectively provided rotational position. Further, the attachment portion has a plurality of engaged portions which are engageable with the engagement portion respectively, said plurality of attached portions being provided in same interval in a circumference direction of the attachment portion. And each engagement element engages with one of the attached portion from said plurality of attached portions in a selectively provided rotational position.

According to this aspect, because the wheel cover is held in a selectively provided rotational position among a plurality of rotational positions, a position of the wheel cover is changed in accordance with an operating state. Further, because said plurality of engaged portions are arranged in same interval and said plurality of engagement elements engage with any one of the engaged portions respectively based on a selectively provided rotational position of the wheel cover, the engagement element can engage with the engaged portion and hold the attachment portion in all the selectively provided rotational positions.

According to a further preferable aspect of the invention, the holding member has a biasing member which biases the engagement portion operating portion. And the engagement portion operating portion is adapted to cancel an engagement between the attachment portion and engagement portion by moving against a biasing force of the biasing member.

According to this aspect, in a state that the attachment portion and the engagement portion are engaged to each other, because the engagement portion operating member is biased by the biasing member, canceling an engagement between the attachment portion and the engagement portion due to an inadvertent external force exerted on the engagement portion operating member is prevented.

According to a further preferable aspect of the invention, the holding member has a regulating portion which prevents a tilting movement of the wheel cover by engaging with the attachment portion.

According to this aspect, because the holding member has the regulating portion, the wheel cover is prevented from being held in a tilted manner. Further, the wheel cover is prevented from being inclined due to a vibration based on an actuation of the grinder.

According to a further preferable aspect of the invention, the attachment portion has a plurality of engaged portions which are engageable with the engagement portion. Further, the grinder comprises a first elastic member which is engageable with the engaged portion, the first elastic member biasing the attachment portion in a direction parallel to an axial direction of the attachment portion. Further, the attachment portion rotates against the collar in a circumference direction and contacts with the collar by means of a biasing force of the first elastic member.

According to this aspect, the wheel cover is positioned at selectively provided rotational position by rotating the attachment portion in a circumference direction against the collar. Further, because the first elastic member biases the attachment portion such that the attachment portion contacts with the collar, when the attachment portion rotates in the circumference direction, an unsteady moving of the attachment portion against the collar is prevented. Further, because the first elastic member engages with the engaged portion, the wheel cover is held at a selectively provided rotational position steadily. Namely, an alignment of the wheel cover in the circumference direction is surely accomplished.

According to a further preferable aspect of the invention, the grinder further comprises a second elastic member which biases the attachment portion via the holding member in the direction parallel to the axial direction of the attachment portion. Further, the attachment portion is adapted to contact with the collar by means of a biasing force of the second elastic member.

According to this aspect, because the second elastic member biases the attachment portion via the holding member such that the attachment portion contacts with the collar, when the attachment portion rotates in the circumference direction, an unsteady moving of the attachment portion against the collar is prevented.

According to a further preferable aspect of the invention, the first elastic member and the second elastic member are formed as a singular member.

According to this aspect, because the first elastic member and the second elastic member are formed as a singular member, a number of components of the grinder is decreased.

According to a further preferable aspect of the invention, a recess is provided on the collar, the recess extending along a circumference direction of the collar at a predetermined position in an axial direction of the collar. Further, the holding member is movable in a radial direction of the collar inside the recess, and is regulated to move in an axial direction of the collar by engaging with the recess.

According to this aspect, because the holding member is held by the recess formed on the collar, it is not necessary to provide a specific member to hold the holding member.

According to the invention, a rational technique with respect to an attaching construction of a wheel cover is provided.

Other objects, features and advantages of the invention will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved grinders and method for using such the grinders and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

A first embodiment of the invention will be explained with reference to FIG. 1 to FIG. 13. This embodiment is one example in which the invention is applied to a grinder. The grinder is a power tool which is adapted to rotate a grinding stone such as a grinding tool or a sanding tool, or a cutting tool and so on, thereby the grinder performs a grinding operation, a sanding operation or a cutting operation and so on against a workpiece.

Figure 1:
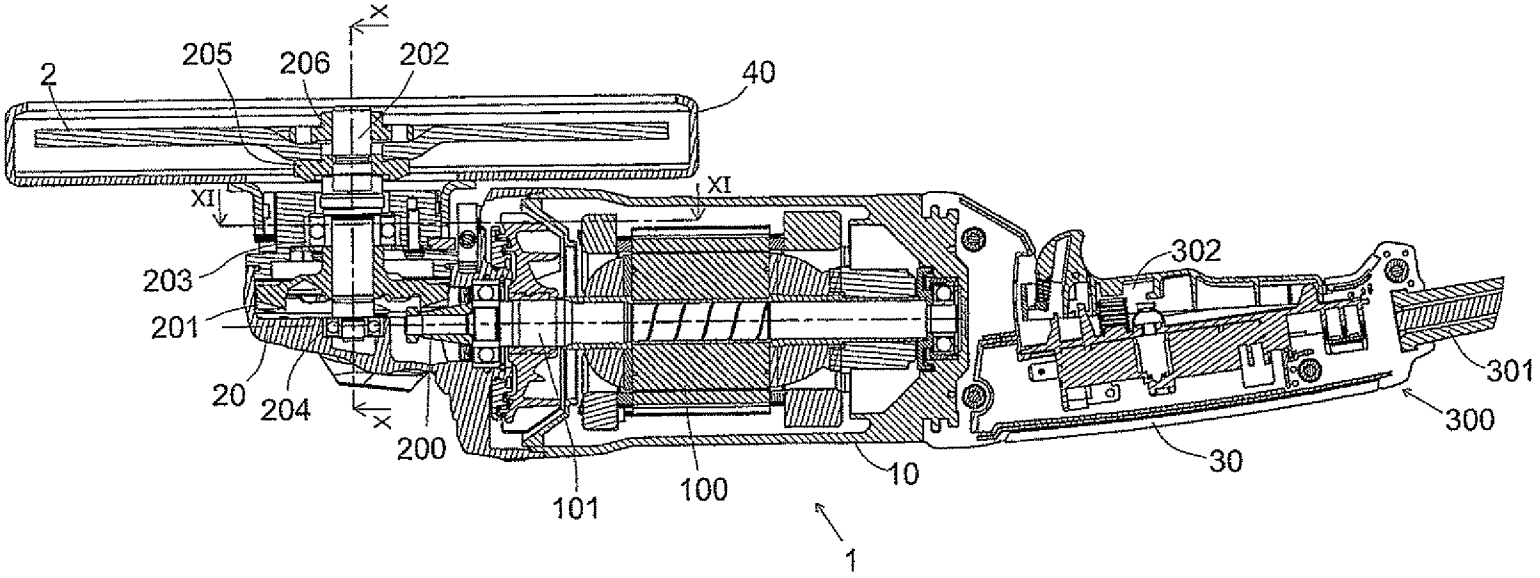
FIG. 1 shows a cross-sectional view of a total composition of a grinder according to a first embodiment of the invention.

As shown in FIG. 1, a grinder 1 is mainly provided with a main housing 10, a gear housing 20, a rear housing 30 and a wheel cover 40 and so on.

The main housing 10 is formed as an approximately cylindrical shaped housing, which houses a motor 100. A rotational shaft 101 of the motor 100 is provided so as to protrude toward the gear housing 20.

The gear housing 20 is provided at one side of the main housing 10. The gear housing 20 houses mainly a first bevel gear 200, a second bevel gear 201, a spindle 202 and bearings 203, 204 and so on. The first bevel gear 200 is provided on an outer surface of the rotational shaft 101 of the motor 100. The second bevel gear 201 is provided so as to engage with the first bevel gear 200. Further, the second bevel gear 201 is connected to the spindle 202 thereby the second bevel gear 201 and the spindle 202 rotate integrally. The spindle 202 is held by bearings 203, 204. Therefore, A rotational output of the motor 100 is converted to a rotation around an axial direction of the spindle 202 which is perpendicular to the rotational shaft 101. An inner flange 205 is provided on the spindle 202 integrally at a distal end part of the spindle 202. Further, a screw thread is provided at the distal end part of the spindle 202 and an outer flange 206 is detachably engaged with the spindle 202. A grinding disk 2 is clamped detachably between the inner flange 205 and the outer flange 206.

The rear housing 30 is provided at an opposite side of the main housing 10 which is opposed to the gear housing 20. The rear housing 30 housed an electrical wiring portion 300. The electrical wiring portion 300 is electrically connected to the motor 100. A power cord 301 which provides current from an external power source, and a switch 302 which is switchable between ON and OFF of a driving of the grinder 1 are provided at the electrical wiring portion 300.

Figure 2:
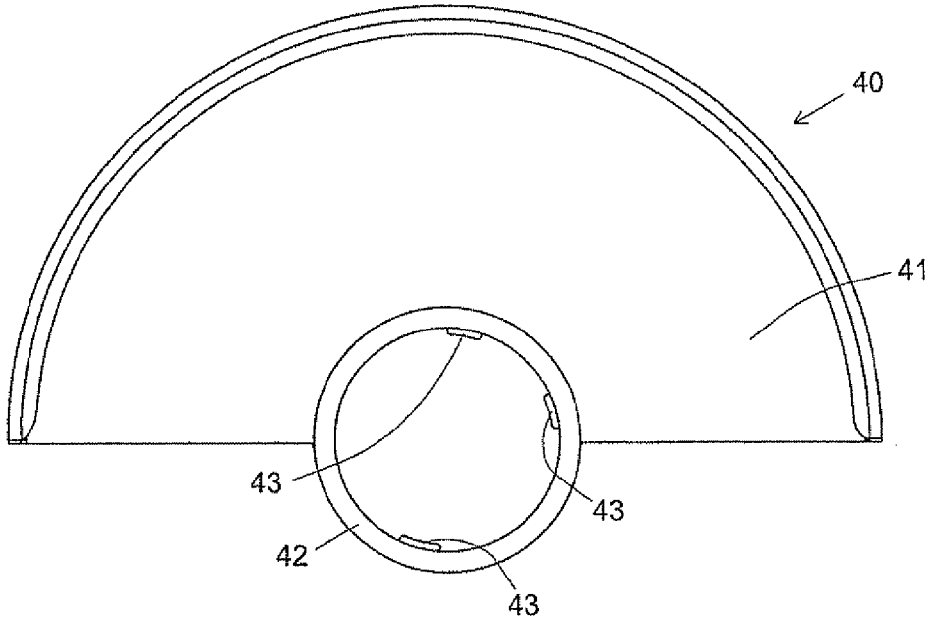
FIG. 2 shows a planar view of a wheel cover.
Figure 3:
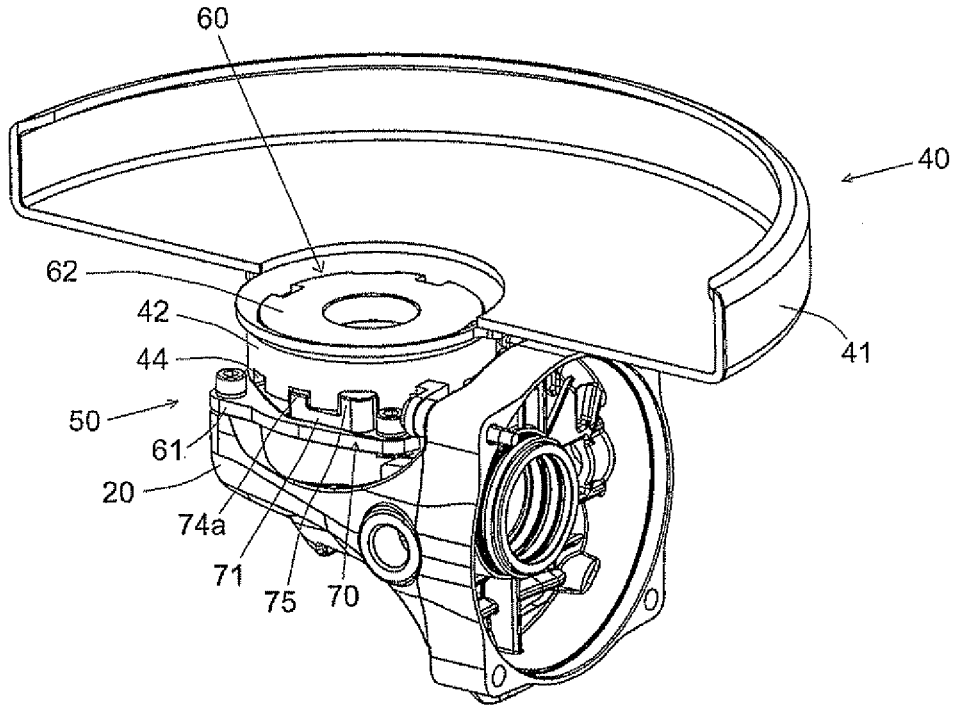
FIG. 3 shows a perspective view of a whole composition of an attachment structure of the wheel cover.
Figure 4:
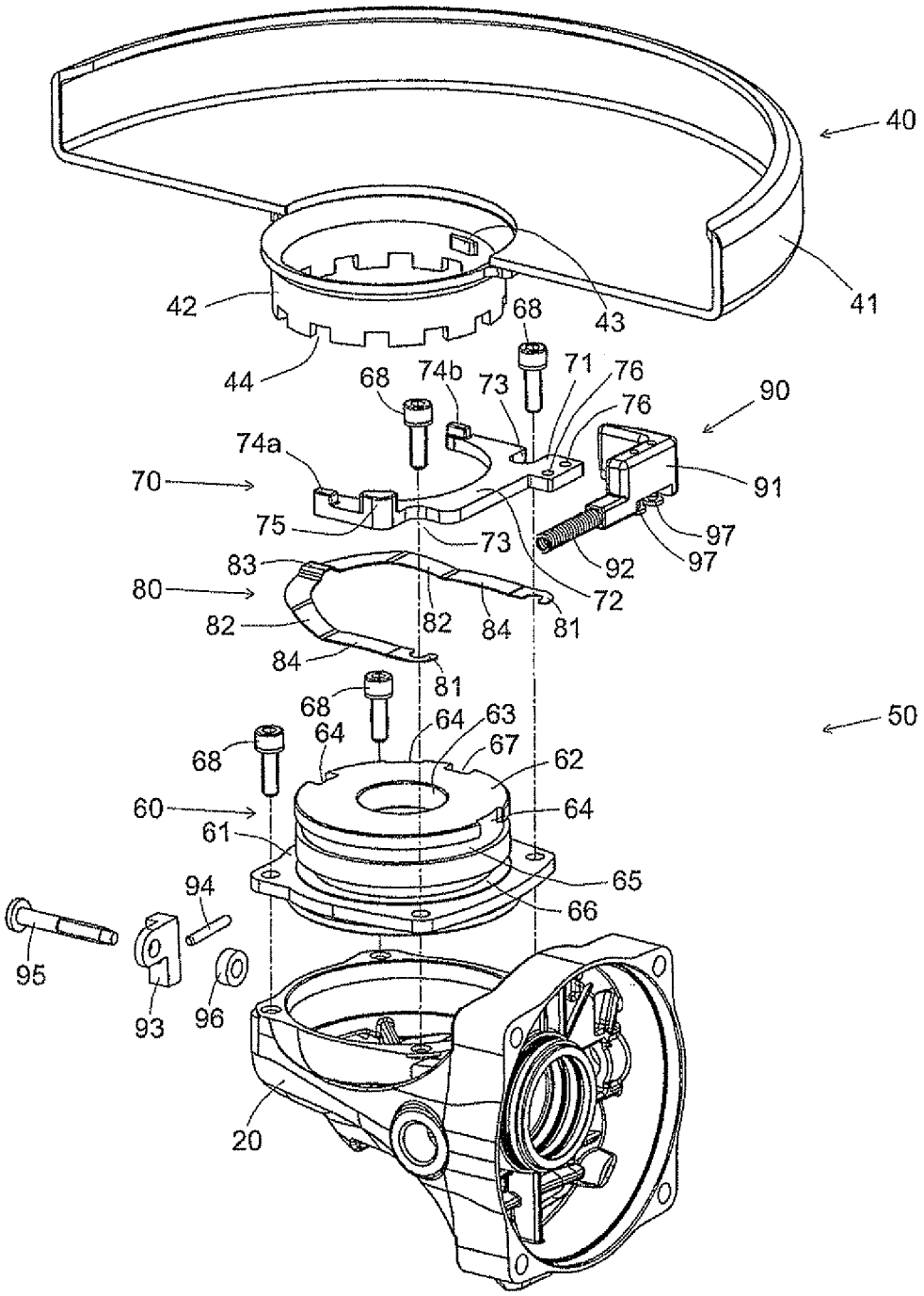
FIG. 4 shows an exploded perspective view of FIG. 3.

As shown in FIG. 2, the wheel cover 40 is a substantially semicircular shaped member in a planar view. The wheel cover 40 is provided with a cover portion 41 and a cylindrical portion 42. Three protrusions 43 which protrude toward inside in a radial direction are provided at the cylindrical portion 42. Further, as shown in FIG. 3 and FIG. 4, engagement recesses 44 are provided at 12 places in a circumference direction at regular intervals on the cylindrical portion 42. As shown in FIG. 1, the wheel cover 40 is attached such that the cylindrical portion 42 is detachably attached to a wheel cover attached portion 50. Therefore, the cover portion 41 is provided so as to cover a half of a circumference of the grinding disk 2. As a result, the wheel cover 40 prevents a part of a workpiece from flying apart and protects a user from the grinding disk 2 which is rotating in a counterclockwise direction in FIG. 2. The wheel cover 40 is one example corresponding to "a wheel cover" of the invention.

Further, the wheel cover 40 and the wheel cover attached portion 50 to which the wheel cover 40 is attached will be explained with reference to FIG. 3 to FIG. 13. Further, in FIG. 3 to FIG. 13, some components except from the wheel cover 40 and the wheel cover attached portion 40 are omitted to be shown for convenience. Further, in FIG. 5 to FIG. 8, the wheel cover 40 is omitted to be shown for convenience. As shown in FIG. 3 to FIG. 8, the wheel cover attached portion 50 is mainly provided with a wheel cover engaging member 60 and a wheel cover holding member 70 and so on.

Figure 5:
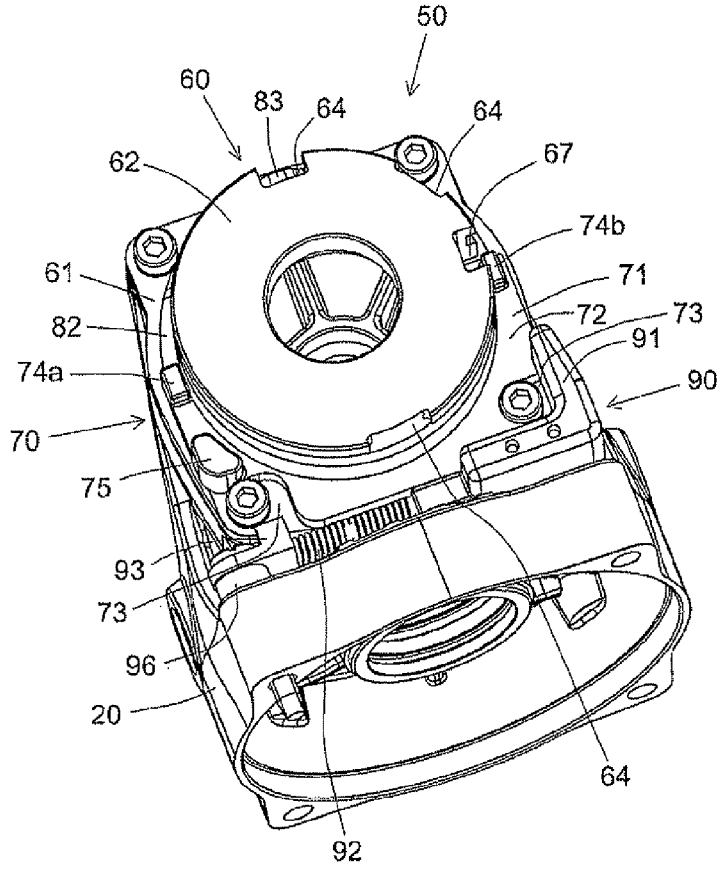
FIG. 5 shows a perspective view of an attachment portion of the wheel cover.
Figure 6:
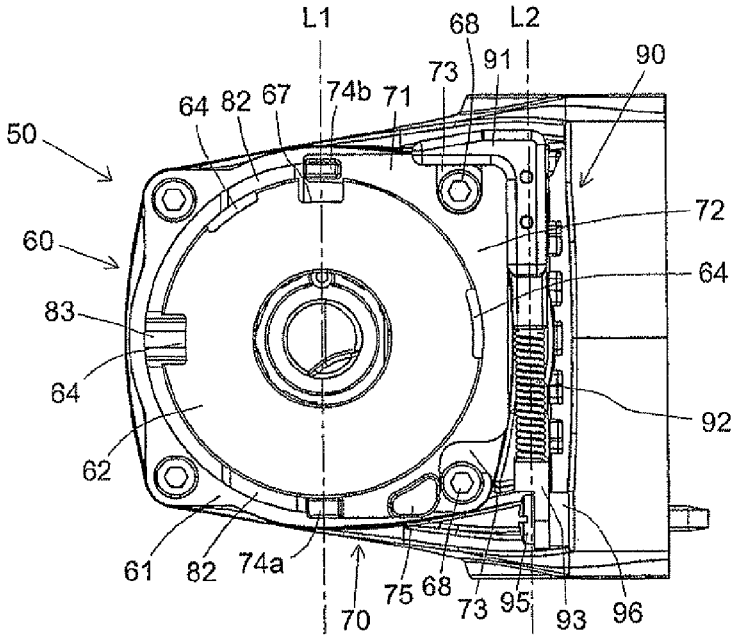
FIG. 6 shows a planar view of FIG. 5.
Figure 7:
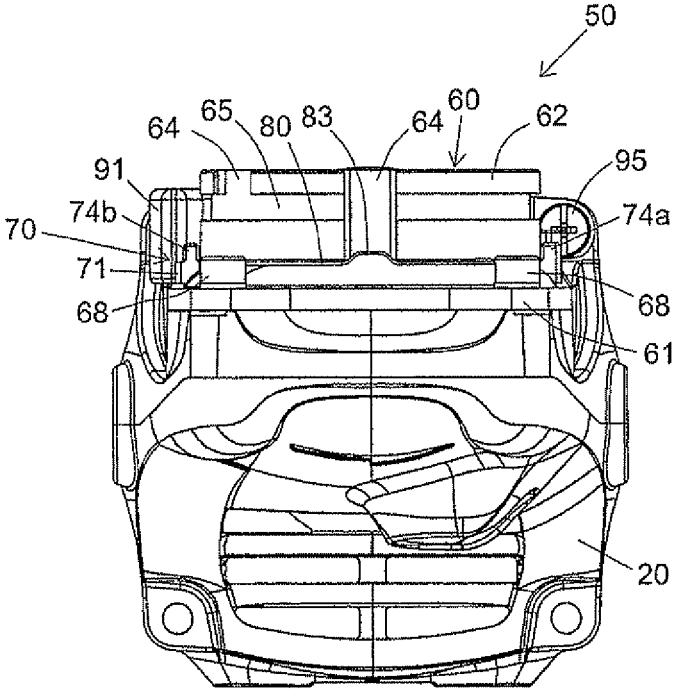
FIG. 7 shows a front view of FIG. 5.
Figure 8:
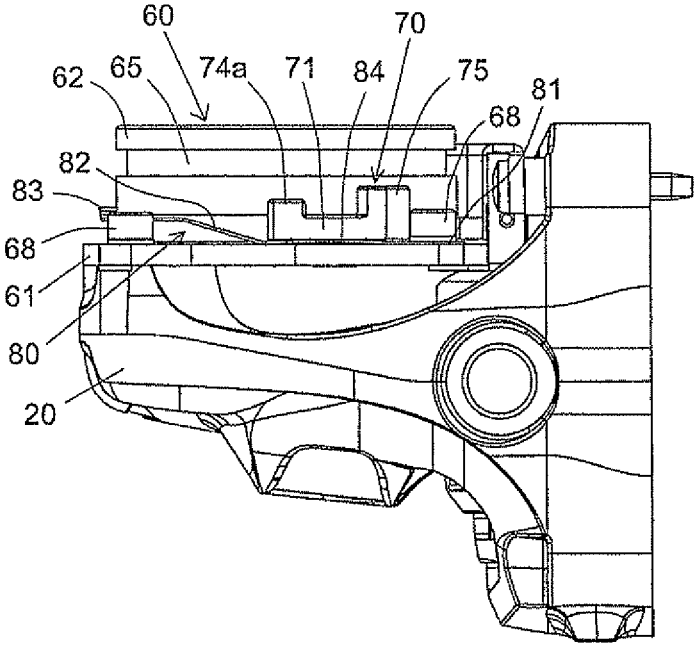
FIG. 8 shows a side view of FIG. 5.

As shown in FIG. 4, the wheel cover engaging member 60 is mainly provided with a base portion 61 and an annular portion 62 which is formed cylindrically and is protruded from the base portion 61. A spindle insert hole 63 through which the spindle 202 penetrates, is formed at a center of the annular portion 62. As shown in FIG. 4 to FIG. 6, a guide groove 64 which guides the three protrusions 43 of the wheel cover 40, is formed at a periphery of the annular portion 62. Further, as shown in FIG. 4, FIG. 7 and FIG. 8, a first engaging groove 65 which is connected to the guide groove 64, is formed at a whole circumference of the annular portion 62 so as to extend in a circumference direction of the annular portion 62. Further, a second engaging groove 66 is formed at a connecting part between the base portion 61 and the annular portion 62 so as to extend in the circumference direction of the annular portion 62. Further, as shown in FIG. 4 to FIG. 6, an evacuating portion 67 at which an engaging protrusion 74*b* of the wheel cover holding member 70 can be positioned by being moved and evacuated toward the center of the annular portion 62, is formed at the periphery of the annular portion 62. The evacuating portion 67 is provided so as to connect to the second engaging groove 66. Further, the wheel cover engaging member 60 is fixed on the gear housing 20 by means of four bolts 68. The annular portion 62 is one example corresponding to "a collar" of the invention.

As shown in FIG. 4, the wheel cover holding member 70 is mainly provided with a slide member 71 and a pressing member 90.

As shown in FIG. 4 to FIG. 6, the slide member 71 includes a flat portion 72 formed as an approximately plain plate member, which is provided to surround approximately half of a circumference of the annular portion 62. The flat portion 72 includes two cutout portions 73 which are formed at two places respectively corresponding to a head of the two bolts 68 protruding from the base portion 61. Further, as shown in FIG. 6, the slide member 71 includes two engaging protrusions 74*a*, 74*b* which are protruded from the flat portion 72. The engaging protrusions 74*a*, 74*b* are arranged at two edge parts of the annular portion 62 respectively, the two edge parts corresponding to where a line L1 crosses the periphery of the annular portion 62, the line L1 passing a center of the annular portion 62 in a direction corresponding to a vertical direction of FIG. 6. Further, the slide member 71 includes a regulating portion 75 which is arranged so as to face to the periphery of the annular portion 62 and to protrude from the flat portion 72. Further, as shown in FIG. 4, two through-holes 76 with which two screws 97 engage are provided on the flat portion 72.

As shown in FIG. 4, a leaf spring 80 is formed as an approximately U-shaped metal member in a planar view. The leaf spring 80 is provided so as to surround approximately half of the circumference of the annular portion 62. Fix portions 81 are provided at two edges of the leaf spring 80 respectively, into which each of the bolts 68 is inserted. Therefore, the leaf spring 80 is fixed on the base portion 61 by means of two bolts 68. As shown in FIG. 4 and FIG. 8, the leaf spring 80 is provided with two first biasing portions 82, an engaging portion 83 and two second biasing portions 84. The two first biasing portions 82 are curved respectively with respect to a direction of a thickness thereof. The engaging portion 83 is provided so as to protrude in the direction of the thickness thereof. The engaging portion 83 is adapted to engage with the engagement portion 44 of the wheel cover 40. The two second biasing portion 84 respectively connect the first biasing portion 82 and the fix portion 81. The second biasing portion 84 is curved with respect to the direction of thickness thereof in a side view.

As shown in FIG. 4 to FIG. 6, a pressing member 90 is adapted to make the slide member 71 connected to the pressing portion 91 slide against the base portion 61 by pressing the pressing portion 91. The pressing portion 91 is formed as an approximately L-shaped member. The pressing portion 91 is provided along a line L2 shown in FIG. 6. In other words, the pressing portion 91 is provided at a tangent region nearby a tangent line of the annular portion 62, which is parallel to the line L1. A coil spring 92 is arranged at a distal end of the pressing portion 91. The coil spring 92 is contacted with a spring contacting portion 93 which is fixed on the gear housing 20. A guide rod 94 is provided on the spring contacting portion 93. Further, the guide rod 94 is inserted into the inside of the coil spring 92. Therefore, the coil spring 92 is adapted to be compressed along the line L2 in FIG. 6, and the pressing portion 91 is adapted to move in a direction to which the line L2 extends. The spring contacting portion 93 is fixed on the gear housing 20 by means of a bolt 95 via a washer 96. Further, two screws 97 are provided at the pressing portion 91, which are engaged with the through-holes 76 of the slide member 71 respectively. Therefore, the slide member 71 and the pressing portion 91 are adapted to move integrally. The line L1 and the line L2 are one example corresponding to "a first line" and "a second line" of the invention respectively.

Figure 9:
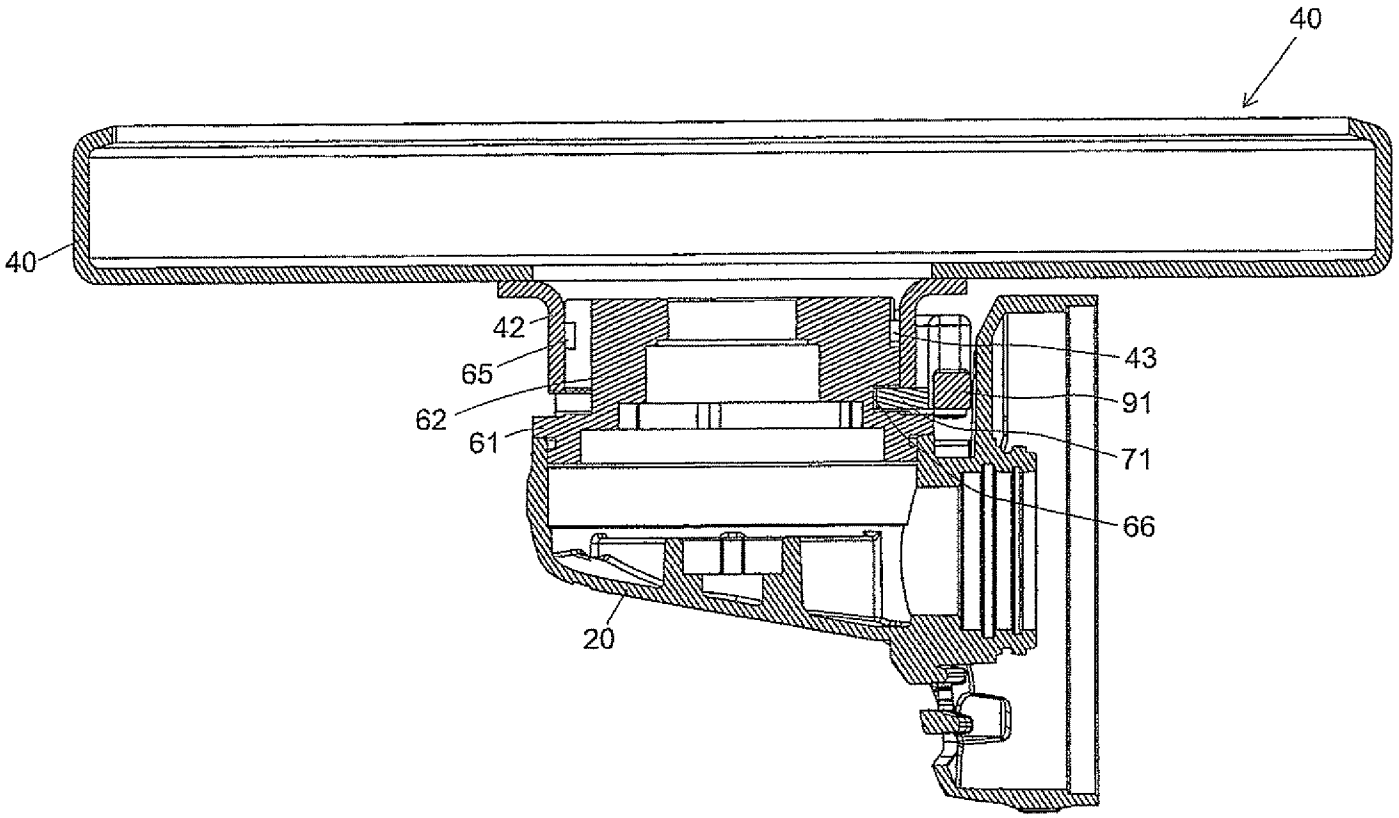
FIG. 9 shows a partially enlarged view of FIG. 1.
Figure 10:
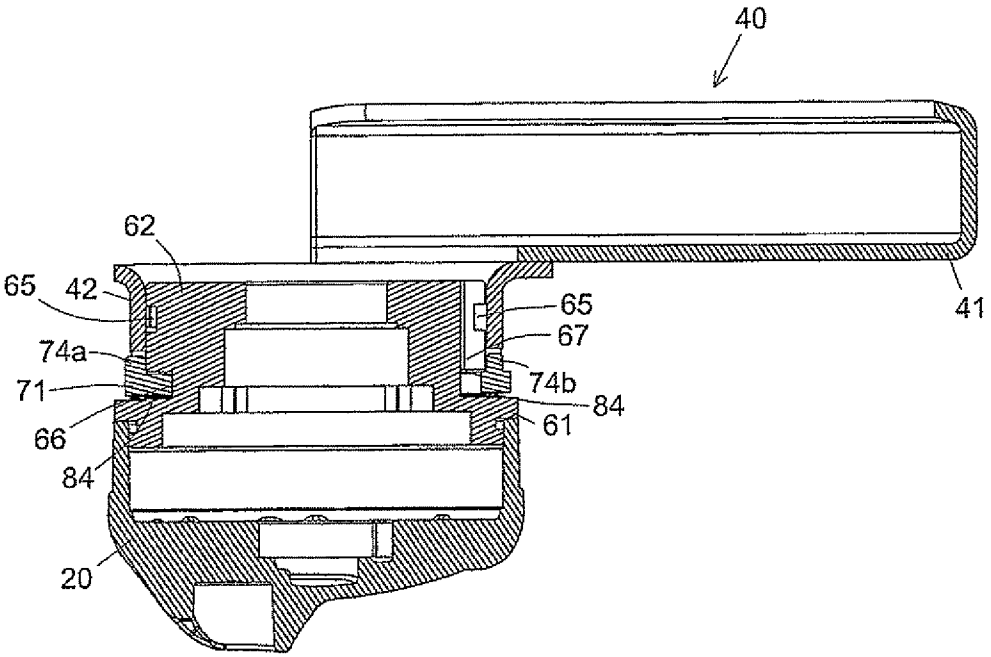
FIG. 10 shows a cross-sectional view taken from X-X of FIG. 1.

As shown in FIG. 5, the wheel cover holding member 70 described above is assembled. Namely, the slide member 71 is adapted to be slidable against the base portion 61. In particular, as shown in FIG. 9 and FIG. 10, the slide member 71 is held in the second engaging groove 66 of the annular portion 62 and is provided so as to be slidable against base portion 61 in the lateral direction of FIG. 10. At this time, as shown in FIG. 8, the second biasing portion 84 of the leaf spring 80 is arranged between the slide portion 71 and the base portion 61. Therefore, the second biasing portion 84 biases the slide portion 71 upward of FIG. 8 against the second engaging groove 66. The second biasing portion 84 is one example corresponding to "a second biasing member" of the invention.

Figure 11:
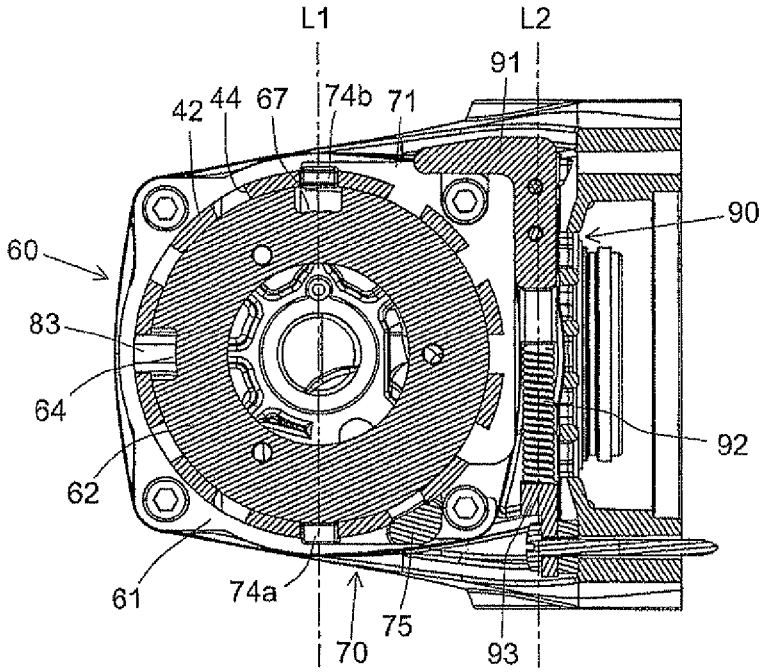
FIG. 11 shows a cross-sectional view taken from XI-XI of FIG. 1.

Further, as shown in FIG. 11, the pressing member 90 holds a coil spring 92 between the pressing portion 91 and the spring contacting portion 93 which is fixed on the gear housing 20 such that the coil spring 92 is held while being compressed. Therefore, the pressing member 90 and the slide member 71 are biased by the coil spring 92 upward in FIG. 11 along the line L2. Namely, the coil spring 92 is provided along the line L2 which is parallelly offset from the line L1 passing the center of the annular portion 62, thereby the pressing member 90 is linearly movable in the direction of the line L2 in the tangent region of the annular portion 62, the tangent region being located around the tangent line which is parallel to the line L1. Further, as shown in FIG. 6, in a state that the wheel cover 40 is not attached, the engaging protrusion 74*a* contacts the annular portion 62 and regulates the pressing member 90 and the slide member 71 to move upward in FIG. 6.

Figure 12:
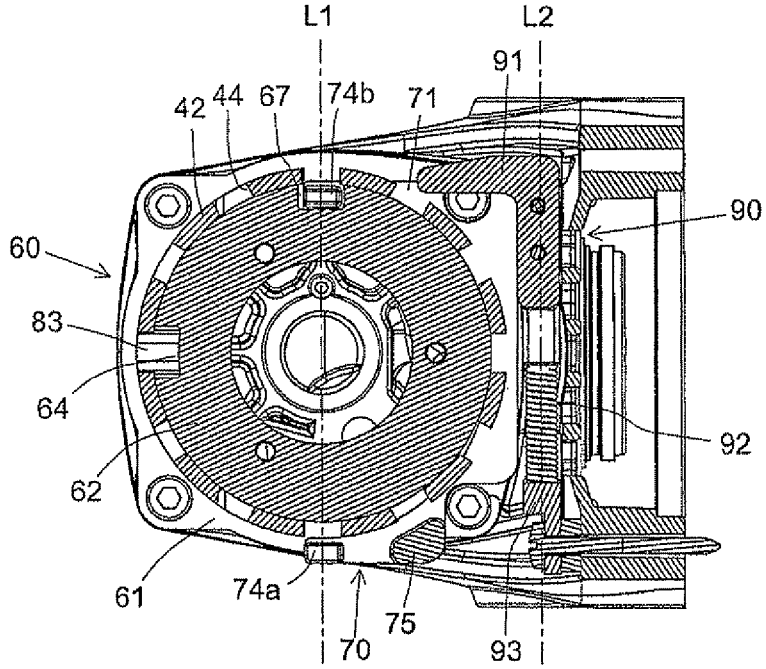
FIG. 12 shows a cross-sectional view in a state that a slide member and a pressing member are moved in accordance with FIG. 11.
Figure 13:
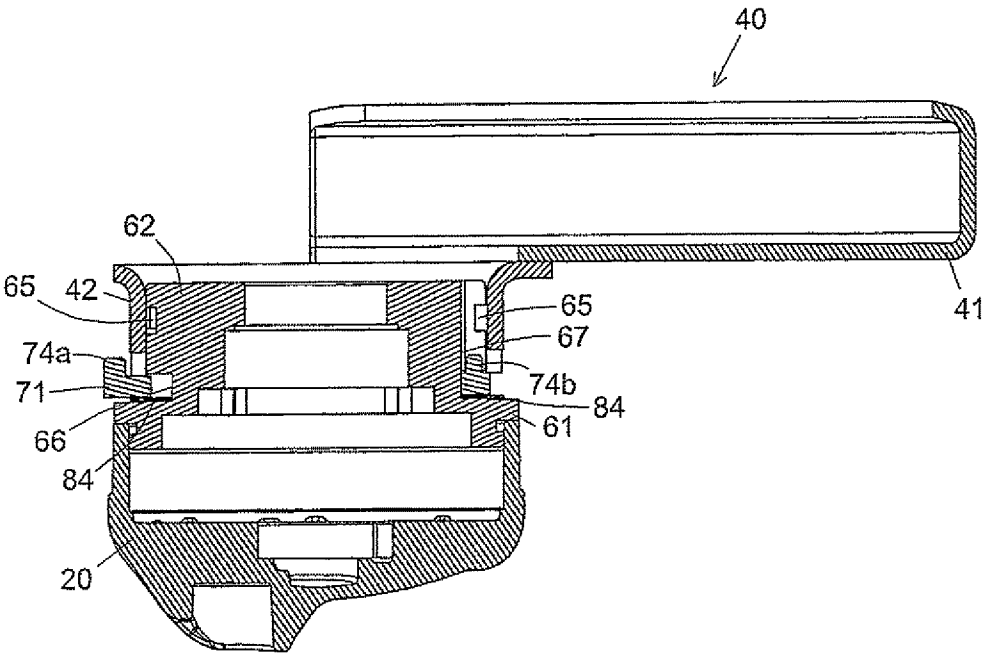
FIG. 13 shows a cross-sectional view in a state that the slide member is moved in accordance with FIG. 10.

On the other hand, as shown in FIG. 12 and FIG. 13, when the slide member 71 is moved by pushing the pressing portion 91 against the biasing force of the coil spring 92, the engaging protrusion 74*b* linearly moves to the center of the annular portion 62 along the line L1 and then contacts the evacuating portion 67. Therefore, the movement of the sliding member downward in FIG. 12 (toward left side in FIG. 13) is regulated. At this time, the engaging protrusion 74*a* linearly moves outward from the center side of the annular portion 62 along the line L1. The wheel cover holding member 70 is one example corresponding to "a holding member" of the invention. Further, the pressing portion 91 is one example corresponding to "an engaging portion manipulating portion" and the coil spring 92 is one example corresponding to "a biasing member" of the invention.

Further, a holding construction in which the wheel cover 40 is held by the wheel cover attached portion 50 will be explained as follows. The wheel cover 40 is detachably attached on the wheel cover attached portion 50. Further, the wheel cover 40 is adapted to be positioned at a plurality of rotational positions against the wheel cover attached portion 50. In particular, the wheel cover 40 is adapted such that the cylindrical portion 42 fixedly engages with the annular portion 62, further the wheel cover 40 is adapted to be rotatable in a circumference direction of the wheel cover attached portion 50. Therefore, the cover portion 41 is positioned at a plurality of rotational positions, each rotational position inclining to the wheel cover attached portion 50 and the gear housing 20 with a predetermined angle respectively. In other words, the wheel cover 40 can be positioned at several positions being different to each other by being rotated against the wheel cover attached portion 50. Therefore, the wheel cover 40 is positioned at one rotational position selected by a user during the plurality of the rotational positions. Accordingly, the wheel cover 40 is attachable at any selectively provided rotational position during the plurality of the rotational positions.

As shown in FIG. 12 and FIG. 13, in case that the wheel cover 40 is attached, the cylindrical portion 42 of the wheel cover 40 is engaged with the annular portion 62 in a state that the engaging protrusions 74*a*, 74*b* is moved by pressing the pressing member 90. At this time, the three protrusions 43 are positioned to match with the guide groove 64 of the annular portion 62. After that, the cylindrical portion 42 is arranged between the annular portion 62 and the regulating portion 75 by moving the wheel cover 40 against the annular portion 62 in an axial direction of the annular portion 62. The cylindrical portion 42 is regulated to move by contacting with the flat portion 72 of the slide member 71. At this time, the protrusion 43 is passed through the guide groove 64 and positioned in the first engaging groove 65. Therefore, the protrusion 43 is held in the first engaging groove 65 rotatably in a circumference direction of the annular portion 62. Further, at this time, the second biasing portion 84 of the leaf spring 80 biases the cylindrical portion 42 via the flat portion 72 upwardly (upper of FIG. 13) in the axial direction of the annular portion 62. Therefore, the protrusion 43 contacts with an upper surface of the first engaging groove 65 (upper surface of FIG. 13). The construction in which the cylindrical portion 42 engages with the annular portion 62 is so called a bayonet connection. The cylindrical portion 42 is one example corresponding to "an attachment portion" of the invention.

Together with the rotation of the wheel cover 40 against the annular portion 62, the engaging portion 83 of the leaf spring 80 engages with one engagement recess 44 of the twelve engagement recesses 44. Namely, by rotating the wheel cover 40 against the annular portion 62, an engagement between the engaging portion 83 and the engagement recess 44 is accomplished and is canceled by means of the elastic deformation of the first biasing portion 82 of the leaf spring 80. Accordingly, the engaging portion 83 is engageable selectively with each engagement recess 44. By engaging the engaging portion 83 with one engagement recess 44, the wheel cover 40 is set at a predetermined position and the rotational position of the wheel cover 40 is determined. Namely, by rotating the wheel cover 40 against the annular portion 62, the wheel cover 40 can position at a plurality of rotational positions against the annular portion 62. At this time, the first biasing portion 82 and the engaging portion 83 of the leaf spring 80 bias the cylindrical portion 42 upwardly (upper in FIG. 13) in the axial direction of the annular portion 62. Therefore, the protrusion 43 contacts with an upper surface (upper surface in FIG. 13) of the first engaging groove 65. The first biasing portion 82 and the engaging portion 83 are one example corresponding to "a first elastic member", and the engagement recess 44 is one example corresponding to "an engaged portion" of the invention.

After determining one rotational position of the wheel cover 40 among a plurality of rotational positions, by cancelling a pressing to the pressing member 90, the slide member 71 is moved together with the pressing member 90 to a position which is shown in FIG. 11 by means of the biasing force of the coil spring 92. Therefore, each engaging protrusion 74*a*, 74*b* respectively engages with the engagement recess 44 of the cylindrical portion 42 and the wheel cover 40 is held such that the wheel cover 40 cannot rotate against the annular portion 62. At this time, the periphery of the cylindrical portion 42 contacts with the regulating portion 75 thereby a movement of the pressing member 90 and the slide member 71 toward upper side of FIG. 11 is regulated. Further, when the regulating portion 75 contacts with the periphery of the cylindrical portion 42, the engaging protrusion 74*a* does not contact with the annular portion 62. The slide member 71 having the engaging protrusions 74*a*, 74*b* is one example corresponding to "an engagement portion" of the invention. Further, each engaging protrusion 74*a*, 74*b* is one example corresponding to "an engagement element" of the invention.

In case that the rotational position of the wheel cover 40 will be changed, as shown in FIG. 12 and FIG. 13, the engaging protrusions 74*a*, 74*b* are moved by pressing the pressing member 90. Therefore, engagements between the engaging protrusions 74*a*, 74*b* and the engagement recess 44 are canceled. At this time, the engaging protrusion 74*b* moves toward the center of the annular 62. On the other hand, the engaging protrusion 74*a* moves toward the outside of the annular portion 62 in a direction from the center side to the outside of the annular portion 62. Namely, the engaging protrusion 74*b* moves to inside of the cylindrical portion 42 and the engaging protrusion 74*a* moves to outside of the cylindrical portion 42, thereby the engagement between the engaging protrusions 74*a*, 74*b* and the engagement recess 44 is canceled. And then, the wheel cover 40 is rotated against the annular portion 62 until the wheel cover 40 positions at the predetermined rotational position. After rotating the wheel cover 40, by canceling the pressing to the pressing member 90, the engaging protrusions 74*a*, 74*b* and the engagement recess 44 engage with each other again. Therefore, the wheel cover 40 is held at the predetermined rotational position.

According to the first embodiment described above, since the pressing member 90 which moves the slide member 71 linearly in the near-field region which is near from the tangent line of the annular portion 62 and the pressing member 90 moves along the line L2 which is parallel to the tangent line which is parallel to the line L1 passing the center of the annular portion 62, in comparison with a construction in which the pressing member 90 linearly moves on the line L1 passing the center of the annular portion 62, the wheel cover attached portion 50 is downsized. For example, in case a pressing member 90 linearly moves on the line L1, a length of the wheel cover attached portion 50 in a direction to which the line L1 extends is sum of a maximum length of a annular portion 62 (a diameter of the annular portion 62) and a length of a motion region of the pressing member 90 (a length between the pressing portion 91 and the spring contacting portion 93). On the other hand, according to the first embodiment, since the pressing member 90 linearly moves in the near-field region which is near from the tangent line of the annular portion 62, which is parallel to the line L1 passing the center of the annular portion 62, a length of the wheel cover attached portion 50 in the direction to which the line L1 extends is only a length of a motion region of the pressing member 90. According to such construction of the wheel cover attached portion 50, the grinder 1 is downsized.

Further, according to the first embodiment, since the slide member 71 and the pressing member 90 are linearly moved, in comparison with a construction in which a component is not moved linearly, a durability of the slide member 71 and the pressing member 90 are improved. Namely, because of the linear movement, the slide member 71 and the pressing member 90 are themselves wholly slid. Therefore, components of the slide member 71 and the pressing member 90 are under an approximately same condition in terms of friction and so on. On the other hand, in case of a construction which is not moved linearly, since rotation and/or torsion are occurred on each component, amount of movement of each component is different. Therefore, stress concentration is occurred on a specific portion. Accordingly, in terms of durability and so on, degradation and/or an abrasion of the specific component are occurred. However, according to the first embodiment, since the slide member 71 and the pressing member 90 are moved linearly, duration of life of the each component of the slide member 71 and the pressing member 90 is increased.

Further, according to the first embodiment, the engaging protrusions 74*a*, 74*b* engage with outside end portions of the cylindrical portion 42, at which a diameter cross, the diameter being parallel to a direction in which the pressing member 90 moves. Namely, since the engaging protrusions 74*a*, 74*b* engage with the engagement recess 44 of the cylindrical portion 42 at the outside end portions which are most distantly positioned to each other, the wheel cover 40 is stably held. Further, the pressing member 90 is linearly moved on the line L2, thereby the engaging protrusions 74*a*, 74*b* are linearly moved on the line L1. Therefore, the engaging protrusions 74*a*, 74*b* engage with the engagement recess 44 at the outside end portions, the outside end portions being most distantly positioned to each other on a diameter of the cylindrical portion 42.

Further, according to the first embodiment, since the engaging protrusion 74*b* is moved toward inside of the annular portion 62 and is positioned at the evacuating portion 67, in comparison with a construction in which both of the engaging protrusion 74*a*, 74*b* moves outward to the annular portion 62, an outline of the grinder 1 is downsized. Further, since the engaging protrusion 74*a* moves outward to the annular portion 62 and the engaging protrusion 74*b* moves inward to the annular portion 62, the slide member 71 is simplified. Namely, by moving the slide member 71 only in one direction, the engaging protrusions 74*a*, 74*b* are moved.

Further, according to the first embodiment, the engaging portion 83 of the leaf spring 80 and the engagement recess 44 are engaged to each other and the engagement between the engaging portion 83 and the engagement recess 44 is canceled based on the rotation of the wheel cover 40. Therefore, when the engaging portion 83 engages with the engagement recess 44, a click feeling is given to a user who rotates the wheel cover 40 by means of an elastic force of the leaf spring 80. Further, the wheel cover 40 is set at the predetermined rotational position steadily.

Further, according to the first embodiment, the second biasing portion 84 of the leaf spring 80 biases the cylindrical portion 42 of the wheel cover 40 via the flat portion 72 of the slide member 70 in the axial direction of the annular portion 62, and the engaging portion 83 of the leaf spring 80 biases the cylindrical portion 42 of the wheel cover 40 in the axial direction. Therefore, three protrusions 43 contact with the upper surface of the first engaging groove 65. In other words, the cylindrical portion 42 contacts with the annular portion 62. Accordingly, the wheel cover 40 is rotated steadily. Further, since the first biasing portion 81, the engaging portion 83 and the second biasing portion 84 are formed by one leaf spring 80, number of components is reduced.

Further, according to the first embodiment, the cylindrical portion 42 is held on the annular portion 62 such that the periphery of the cylindrical portion 42 contacts with the regulating portion 75. Therefore, an instability of a holding of the wheel cover 40 due to a vibration occurred during an operation of the grinder 1 is regulated. Further, when the wheel cover 40 is rotated, because the regulating portion 75 contacts with the cylindrical portion 42, the wheel cover 40 is smoothly rotated.

Further, according to the first embodiment, since the second engaging groove 66 is formed on the periphery of the annular portion 62 so as to extend in the circumference direction and the slide member 71 engages with the second engaging groove 66, a movement of the slide member 71 in the axial direction of the annular portion 62 is regulated. Accordingly, the slide member 71 is slide steadily against the base portion 61. Further, since the cutout portion 73 is formed on the slide member 71 at a position corresponding to the bolt 68, a head part of the bolt 68 prevents the slide member 71 from dropping off from the annular portion 62.

Further, two variations of the first embodiment will be explained with reference to FIG. 14 and FIG. 15. In the variations, components similar to the first embodiment are assigned same number as the first embodiment and explanations of the components are omitted.

Figure 14:
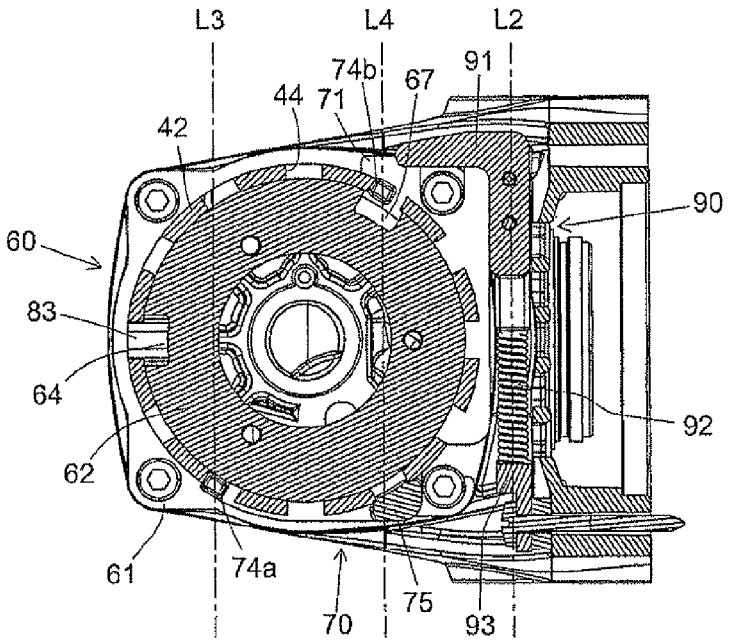
FIG. 14 shows a cross-sectional view according to a first variation of the first embodiment, which corresponds to FIG. 11.

As shown in FIG. 14, in a first variation, the engaging protrusions 74*a*, 74*b* moves on a line L3, L4 respectively. The lines L3, L4 are respectively parallel to a direction to which the line L2 extends, wherein the pressing member 90 moves along the line L2. The lines L3, L4 are adapted to pass the center region of the cylindrical portion 42 respectively. Further, the engaging protrusions 74*a*, 74*b* are adapted to engage respectively with outside end portions of the cylindrical portion 42, the outside end portions being crossed the line L3, L4 respectively. Namely, the engaging protrusion 74*a* engages with the outside end portion of the cylindrical portion 42, the outside end portion being a part of the cylindrical portion 42 which the line L3 crosses. On the other hand, the engaging protrusion 74*b* engages with the outside end portion of the cylindrical portion 42, the outside end portion being a part of the cylindrical portion 42 which the line L4 crosses. The engaging protrusions 74*a*, 74*b* are provided approximately symmetrically with respect to the center of the cylindrical portion 42. According to the first variation, the engaging protrusions 74*a*, 74*b* are respectively engaged with the engagement recesses 44 at positions at which a diameter crosses the cylindrical portion 42, the positions being the most distantly separated to each other. Therefore, the wheel cover 40 is held steadily.

Figure 15:
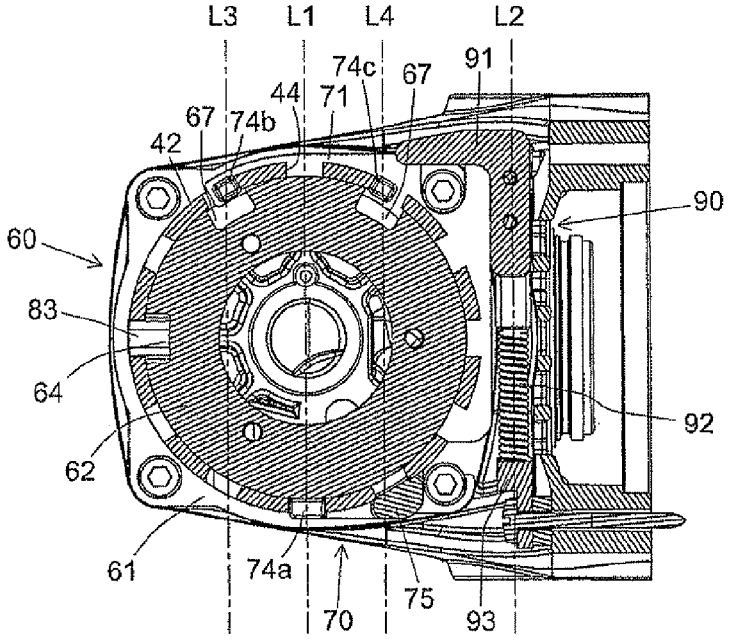
FIG. 15 shows a cross-sectional view according to a second variation of the first embodiment, which corresponds to FIG. 11.

Further, as shown in FIG. 15, in a second variation, three engaging protrusions 74*a*, 74*b*, 74*c* are provided. The engaging protrusions 74*a*, 74*b*, 74*c* moves on a line L1, L3, L4 respectively. Namely, the engaging protrusion 74*a* engages with the outside end portion of the cylindrical portion 42, the outside end portion being a part of the cylindrical portion 42 which the line L1 crosses. Further, the engaging protrusion 74*b*, 74*c* engages respectively with the outside end portions of the cylindrical portion 42, the outside end portions being parts of the cylindrical portion 42 which the line L3, L4 crosses respectively. The engaging protrusions 74*a*, 74*b*, 74*c* are provided approximately symmetrically with respect to the center of the cylindrical portion 42. According to the second variation, since the engaging protrusions 74*a*, 74*b*, 74*c* are provided approximately symmetrically, the wheel cover 40 is held steadily.

Second Embodiment

A second embodiment will be explained with reference to FIG. 16 to FIG. 20. In the second embodiment, a wheel cover engaging member 160, a wheel cover holding member 170 and a leaf spring 180 are different from the first embodiment. Therefore, components being similar to the first embodiment will be signed same number as the first embodiment and explanations thereof are omitted for convenience.

Figure 16:
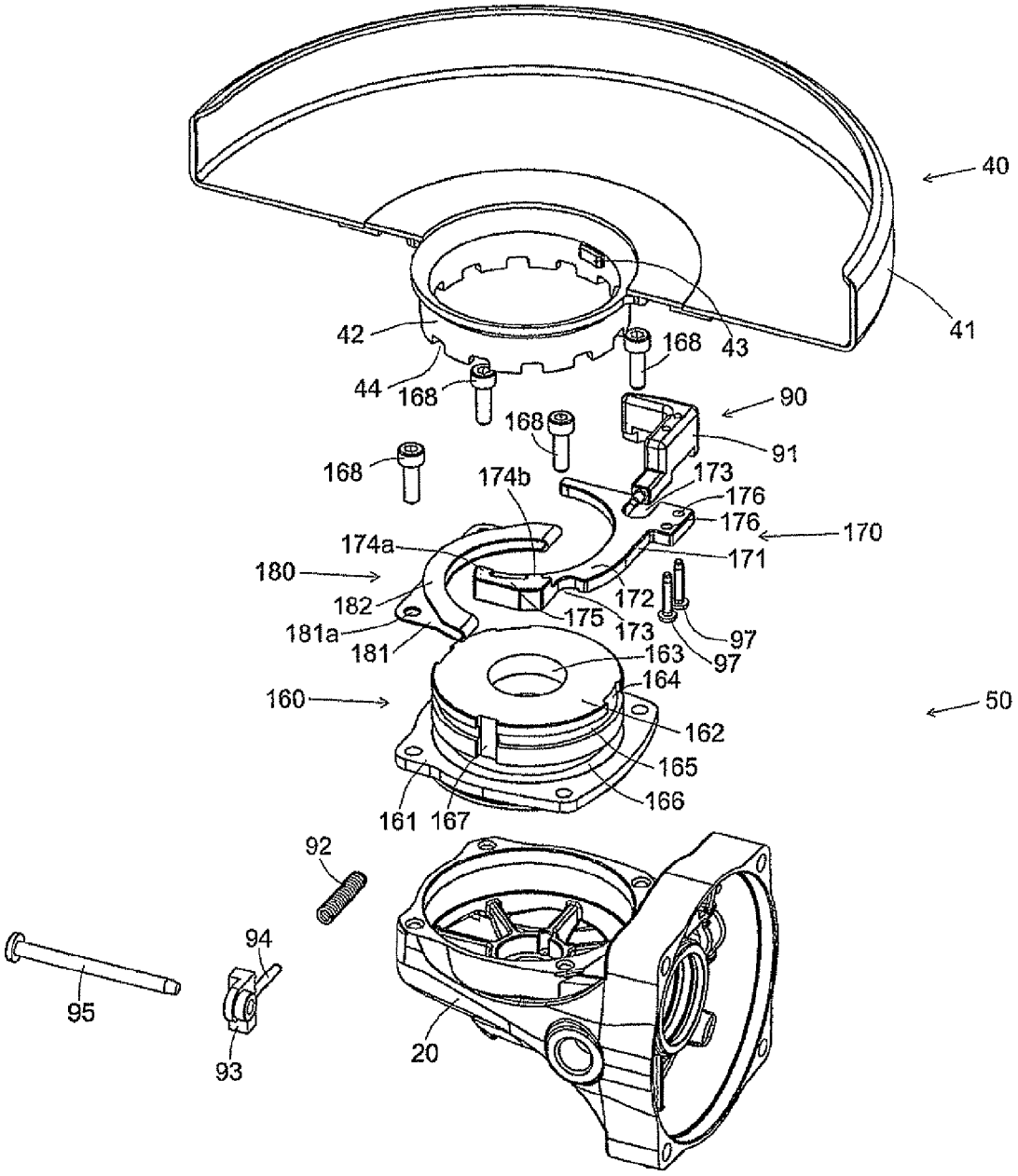
FIG. 16 shows an exploded perspective view according to a second embodiment, which corresponds to FIG. 4.
Figure 17:
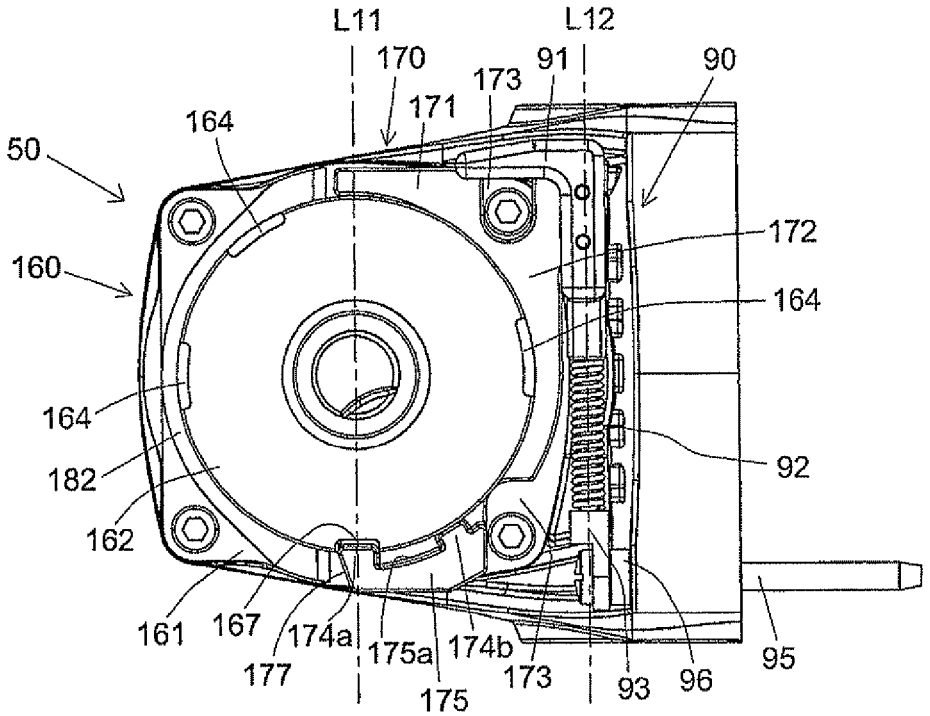
FIG. 17 shows a planar view according to the second embodiment, which corresponds to FIG. 6.

As shown in FIG. 16, the wheel cover engaging member 160 is mainly provided with a base 161, a cylindrical shaped annular portion 162 which protrudes from the base 161. A spindle insert hole 163 through which the spindle 202 penetrates, is formed at a center of the annular portion 162. As shown in FIG. 16 and FIG. 17, a guide groove 164 which guides the three protrusions 43 of the wheel cover 40, is formed at a periphery of the annular portion 162. Further, a first engaging groove 165 which is connected to the guide groove 164, is formed at a whole circumference of the annular portion 162 so as to extend in a circumference direction of the annular portion 162. Further, a second engaging groove 166 is formed at a connecting part between the base 161 and the annular portion 162 so as to extend in the circumference direction of the annular portion 162. Further, an engaging groove 167 with which an engaging protrusion 174*a* of the wheel cover holding member 170 can engage, is formed at the periphery of the annular portion 162. Further, the wheel cover engaging member 160 is fixed on the gear housing 20 by means of four bolts 168. The annular portion 162 is one example corresponding to "a collar" of the invention.

Figure 18:
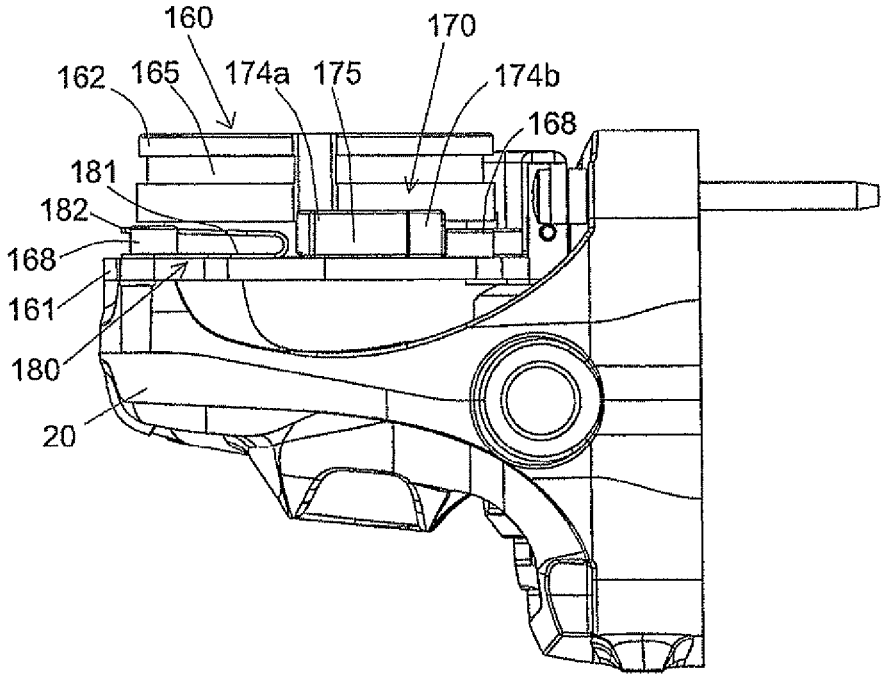
FIG. 18 shows a side view according to the second embodiment, which corresponds to FIG. 8.

As shown in FIG. 18, the wheel cover holding member is mainly provided with a slide member 171 and the pressing member 90.

As shown in FIG. 16 and FIG. 17, the slide member 171 includes two engaging protrusions 174*a*, 174*b* which protrude from a flat portion 172. A tapered surface 177 is provided at a side of the engaging protrusion 174*a*. As shown in FIG. 17, the tapered surface is formed such that a width of the engaging protrusion 174*a* in a planar view is widened toward the center of the annular portion 162. The two engaging protrusions 174*a*, 174*b* are connected to each other by a connecting portion 175. An inner surface 175*a* of the connecting portion 175 is formed as an arc-shaped surface and is faced to the periphery of the annular portion 162.

Further, as shown in FIG. 16 and FIG. 18, the leaf spring 180 is an approximately U-shaped member in the planar view, which is made of metal. The leaf spring 180 is provided with a flat shaped base portion 181 and a biasing portion 182 which is bent from the base portion 181. Through-holes 181*a* through which the bolts 168 penetrate respectively are arranged on the base portion 181. Accordingly, the leaf spring 180 is fixed on the base 161 by means of the bolt 168.

As to the wheel cover holding member 170 described above, as shown in FIG. 19, the pressing member 90 holds the coil spring 92 between the pressing portion 91 and the spring contacting portion 93 which is fixed on the gear housing 20 such that the coil spring 92 is held while being compressed. Therefore, the pressing member 90 and the slide member 171 are biased by the coil spring 92 upward in FIG. 19 along a line L12. Namely, the coil spring 92 is provided along the line L12 which is parallelly offset from a line L11 passing the center of the annular portion 162, thereby the pressing member 90 is linearly movable in a direction of the line L12 in the tangent region of the annular portion 62, the tangent region being located around a tangent line which is parallel to the line L11.

Figure 20:
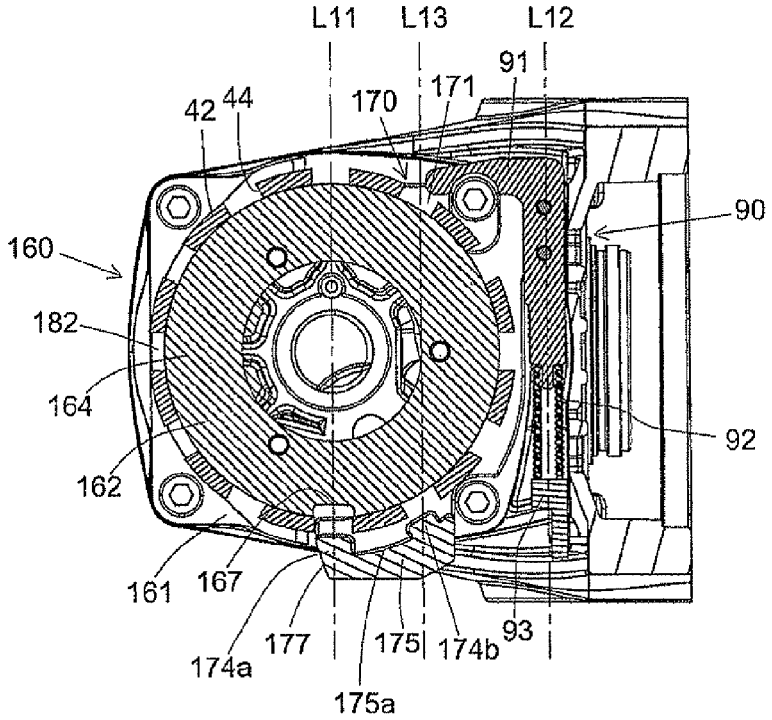
FIG. 20 shows a cross-sectional view according to the second embodiment, which corresponds to FIG. 12.

On the other hand, as shown in FIG. 20, when the slide member 171 is moved by pushing the pressing portion 91 against the biasing force of the coil spring 92, the engaging protrusion 174*a* moves linearly on the line L11 and the engaging protrusion 174*b* moves linearly on a line L13. At this time, the flat portion 172 is contacted with the annular portion 162 and a movement of the slide member 171 downward in FIG. 20 is regulated.

As shown in FIG. 20, in case that the wheel cover 40 is attached, the cylindrical portion 42 of the wheel cover 40 is engaged with the annular portion 162 in a state that the engaging protrusions 174*a*, 174*b* is moved by pressing the pressing member 90. At this time, the three protrusions 43 are positioned to match with the guide groove 164 of the annular portion 162. After that, the cylindrical portion 42 is arranged between the annular portion 162 and the connecting portion 175 by moving the wheel cover 40 against the annular portion 162 in an axial direction of the annular portion 162. The cylindrical portion 42 is regulated to move by contacting with the flat portion 172 of the slide member 171. At this time, the protrusion 43 is passed through the guide groove 164 and positioned in the first engaging groove 165. Therefore, the protrusion 43 is held in the first engaging groove 165 rotatably in a circumference direction of the annular portion 162. Further, at this time, the biasing portion 182 of the leaf spring 180 biases the cylindrical portion 42 upwardly in the axial direction of the annular portion 162. Therefore, the protrusion 43 contacts with an upper surface of the first engaging groove 165.

Figure 19:
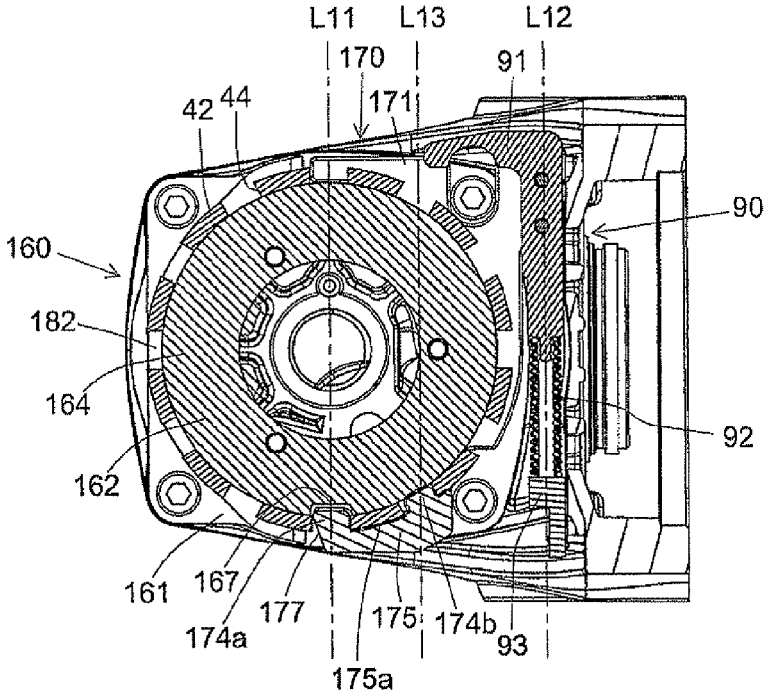
FIG. 19 shows a cross-sectional view according to the second embodiment, which corresponds to FIG. 11.

After determining one rotational position of the wheel cover 40 among a plurality of rotational positions, by canceling a pressing to the pressing member 90, the slide member 171 is moved together with the pressing member 90 to a position which is shown in FIG. 19 by means of the biasing force of the coil spring 92. Therefore, each engaging protrusion 174*a*, 174*b* respectively engages with the engagement recess 44 of the cylindrical portion 42 and further the engaging protrusion 174*a* engages with the engaging groove 167. As a result, the wheel cover 40 is held such that the wheel cover 40 cannot rotate against the annular portion 162. At this time, the periphery of the cylindrical portion 42 contacts with the connecting portion 175 thereby a movement of the pressing member 90 and the slide member 171 toward upper side of FIG. 19 is regulated. Further, the tapered surface 177 of the engaging protrusion 174*a* is provided to be inclined from a side surface of the engagement recess 44, the side surface forming the engagement recess 44.

In case that the rotational position of the wheel cover 40 will be changed, as shown in FIG. 20, the engaging protrusions 174*a*, 174*b* are moved by pressing the pressing member 90. At this time, the engaging protrusions 174*a*, 174*b* move outward from the center side of the annular portion 162. Therefore, engagements between the engaging protrusions 174*a*, 174*b* and the engagement recess 44 are canceled. And then, the wheel cover 40 is rotated against the annular portion 162 until the wheel cover 40 positions at the predetermined rotational position. After rotating the wheel cover 40, by canceling the pressing to the pressing member 90, the engaging protrusions 174*a*, 174*b* and the engagement recess 44 engage with each other again. Therefore, the wheel cover 40 is held at the predetermined rotational position.

According to the second embodiment, as similar to the first embodiment, the wheel cover attached portion 50 is downsized. As a result, the grinder 1 is downsized. Further, since the slide member 171 and the pressing member 90 are moved linearly, duration of life of the each component of the slide member 171 and the pressing member 90 is increased. Further, since the cylindrical portion 42 is held by the annular portion 162 such that the periphery of the cylindrical portion 42 contacts with the inner surface 175*a* of the connecting portion 175, an instability of a holding of the wheel cover 40 due to a vibration occurred during an operation of the grinder 1 is regulated.

Further, according to the second embodiment, since the second engaging groove 166 is provided on the periphery of the annular portion 162 in the circumference direction and the slide member 171 engages with the second engaging groove 166, the slide member 171 is regulated from moving in the axial direction of the annular portion 162. Accordingly, the slide member 171 is slid steadily against the base portion 161. Further, since the cutout portion 173 is formed on the slide member 171 at a position corresponding to the bolt 168, a head part of the bolt 168 prevents the slide member 171 from dropping off from the annular portion 162.

Further, according to the second embodiment, since the tapered surface 177 is arranged on the side of the engaging protrusion 174*a*, the width of the engaging protrusion 174*a* is widened toward the center of the annular portion 162. Therefore, in case that an external force inadvertently exerts on the wheel cover 40 to be rotated when the grinder 1 is working, the cylindrical portion 42 is deformed outward in a radial direction of the wheel cover 40. Namely, in case that the wheel cover 40 is rotated in a counterclockwise direction in FIG. 19 by the external force, since the tapered surface 177 is provided on the engaging protrusion 174*a* with which the cylindrical portion 42 engages, the cylindrical portion 42 on which the engagement recess 44 is provided deforms outward in the radial direction of the wheel cover 40 along the tapered surface 177. Accordingly, an energy based on the external force is changed into a deformation of the cylindrical portion 42. On the other hand, if a tapered surface is not formed on the engaging protrusion 174*a*, in case that the wheel cover 40 is rotated in the counterclockwise direction by an external force, the cylindrical portion 42 cannot deform outward in the radial direction of the wheel cover 40. Therefore, the engaging protrusion 174*a* is pressed by a side surface of the cylindrical portion 42 and is rotated in the counterclockwise direction. Namely, the engaging protrusion 174*a* is pressed by the cylindrical portion 42 thereby the slide member on which the engaging protrusion is arranged contacts with a head part of the bolt 168. Accordingly, it is possible that the flat portion 172 and/or the bolt 168 are/is damaged. Namely, the energy based on the external force is changed into a partial deformation of the wheel cover attached portion 50. As described above, according to the second embodiment, since the tapered surface 177 is arranged on the side of the engaging protrusion 174*a*, in case that the external force which rotates the wheel cover is inadvertently exerted on the wheel cover 40, the wheel cover 40 can deform itself. Therefore, the wheel cover attached portion 50 which is one part of a main body side the grinder 1 is prevented from being damaged.

Further, according to the second embodiment, the throughhole 181*a* is arranged at the base portion 181 of the leaf spring 180. Therefore, when the bolt 168 is screwed, the throughhole 181*a* is prevented from deforming. Accordingly, the leaf spring 180 is steadily fixed on the base portion 161.

In the first and the second embodiments described above, the wheel cover 40 is adapted to be attachable to the wheel cover attached portion 50, however it is not limited to such construction. Namely, as long as the wheel cover 40 is adapted to be rotatable and attached at a plurality of rotational position on the wheel cover attached portion 50, the wheel cover 40 may be adapted to be undetachable from the wheel cover attached portion 50.

Further, in the first embodiment and the second embodiment, the engaging protrusions are disposed approximately symmetrically to each other against the center of the cylindrical portion 42, however it is not limited to such construction. Namely, the engaging protrusions may be disposed unsymmetrically to each other. Further, as to the explanation described above, it is explained by utilizing a construction in which includes more than two engaging protrusions, only one engaging protrusion may be disposed. In case that only one engaging protrusion is disposed, it is preferable that the engagement between the engaging protrusion and the engagement recess 44 may be canceled by moving the engaging protrusion toward inside of the cylindrical portion 42.

Having regard to an aspect of the invention, following features are provided:

(Feature 1)

A grinder comprising:

a body which has a collar;

a wheel cover which is attachable to the collar; and a holding member which holds the wheel cover fixedly to the collar, wherein the wheel cover has an annular shaped attachment portion which is attachable to the collar, wherein the wheel cover is selectively located at one rotational position from a plurality of rotational positions which are different to each other, and the wheel cover is attachable to the collar in a selectively provided rotational position, wherein the holding member has an engagement portion which is engageable with the attachment portion, wherein the attachment portion has a plurality of attached portions which are engageable with the engagement portion respectively, each attached portion having two surfaces which face to each other and cross a direction in which the wheel cover rotates respectively, wherein the engagement portion has a tapered surface which inclines to at least one of surfaces.

(Feature 2)

The grinder according to any one of claims 1 to 10, wherein the attachment portion has a plurality of attached portions which are engageable with the engagement portion respectively, each attached portion having two surfaces which face to each other and cross a direction in which the wheel cover rotates respectively, wherein the engagement portion has a tapered surface which inclines to at least one of surfaces.

(Feature 3)

The grinder according to any one of claims 4 to 8, further comprising a connecting portion which connects said plurality of engagement elements to each other, the connecting portion being contactable with the attachment portion, wherein the attachment portion is held by the collar and the connecting portion.

(Feature 4)

The grinder according to claim 11, wherein the first elastic member has a base portion and a biasing portion, the base portion being fixed on the body, the biasing portion biasing the attachment portion, and wherein the first elastic member is formed by a bent elastic plate such that a first surface of the base portion with which the body contacts and a second surface of the biasing portion with which the attachment portion contacts are connected to each other.

(Feature 5)

The grinder according to any one of claims 1 to 10 or features 1 to 3, further comprising a first elastic member which biases the attachment portion in a direction parallel to an axial direction of the attachment portion, wherein the attachment portion rotates against the collar in a circumference direction and contacts with the collar by means of a biasing force of the first elastic member.

(Feature 6)

The grinder according to feature 5, wherein the first elastic member has a base portion and a biasing portion, the base portion being fixed on the body, the biasing portion biasing the attachment portion, and wherein the first elastic member is formed by a bent elastic plate such that a first surface of the base portion with which the body contacts and a second surface of the biasing portion with which the attachment portion contacts are connected to each other.

(Feature 7)

The grinder according to feature 6, wherein the first elastic member is made of a metal leaf spring.

A correspondence relation between each component of the embodiments and the invention will be explained as follows. Further, each embodiment is one example to utilize the invention and the invention is not limited to the embodiments.

The annular portion 62, 162 corresponds to "a collar" of the invention.

The wheel cover 40 corresponds to "a wheel cover" of the invention.

The cylindrical portion 42 corresponds to "an attachment portion" of the invention.

The engagement recess 44 corresponds to "an engaged portion" of the invention.

The wheel cover holding member 70, 170 corresponds to "a holding member" of the invention.

The slide member 71, 171 corresponds to "an engagement portion" of the invention.

The engaging protrusion 74*a*, 74*b*, 74*c*, 174*a*, 174*b* corresponds to "an engagement element" of the invention.

The pressing portion 91 corresponds to "an engagement portion operating member" of the invention.

The line L1, L11 corresponds to "a first line" of the invention.

The line L2, L12 corresponds to "a second line" of the invention.

The coil spring 92 corresponds to "a biasing member" of the invention.

The regulating portion 75 corresponds to "a regulating portion" of the invention.

The connecting portion 175 corresponds to "a regulating portion" of the invention.

The first biasing portion 82 corresponds to "a first elastic member" of the invention.

The engaging portion 83 corresponds to "a first elastic member" of the invention.

The second biasing portion 84 corresponds to "a second elastic member" of the invention.

The second engaging groove 66, 166 corresponds to "a recess" of the invention.

The tapered surface 177 corresponds to "a tapered surface" of the invention.

DESCRIPTION OF NUMERALS

1 grinder
2 grinding disk
10 main housing
20 gear housing
30 rear housing
40 wheel cover
41 cover portion
42 cylindrical portion
43 protrusion
44 engagement recess
50 wheel cover attached portion
60 wheel cover engaging member
61 base portion
62 annular portion
63 spindle insert hole
64 guide groove
65 first engaging groove
66 second engaging groove
67 evacuating portion
68 bolt
70 wheel cover holding member
71 slide member
72 flat portion
73 cutout portion
74*a*, 74*b*, 74*c* engaging protrusion
75 regulating portion
76 through-hole
80 leaf spring
81 fix portion
82 first biasing portion
83 engaging portion
84 second biasing portion
90 pressing member
91 pressing portion
92 coil spring
93 spring contacting portion
94 guide rod
95 bolt
96 washer
97 screw
100 motor
101 rotational shaft
160 wheel cover engaging member
161 base portion
162 annular portion
163 spindle insert hole
164 guide groove
165 first engaging groove
166 second engaging groove
167 engaging groove
168 bolt
170 wheel cover holding member
171 slide member
172 flat portion
173 cutout portion
174*a*, 174*b* engaging protrusion
175 connecting portion
175*a* inner surface
176 through-hole
177 tapered surface
180 leaf spring
181 base portion
181*a* through-hole
182 biasing portion
200 first bevel gear
201 second bevel gear
202 spindle
300 electrical wiring portion
L1, L2, L3, L4 line
L11, L12, L13 line

What is claimed is:

1. A grinder comprising:

a body which has a collar;

a wheel cover which is attachable to the collar; and a holding member which is adapted to hold the wheel cover fixedly to the collar, wherein the wheel cover has an annular shaped attachment portion which is attachable to the collar, the holding member has an engagement portion and an engagement portion operating member to move the engagement portion, the engagement portion being engageable with the attachment portion, the engagement portion operating member switches a state between (i) an engagement state in which the attachment portion and the engagement portion are engaged to each other, and (ii) a disengagement state in which the attachment portion and the engagement portion are disengaged to each other by moving the engagement portion, the engagement portion operating member is configured to slide linearly on a second line, which is offset in the radial direction of the annular shaped attachment portion from and parallel to a first line that extends diametrically across the annular shaped attachment portion, to switch the state, and the engagement portion is adapted to cancel an engagement with the attachment portion by moving to inside of the attachment portion.

2. The grinder according to claim 1, wherein the engagement portion is engageable with an outer edge of the attachment portion, the outer edge being located on a line passing a central region of the attachment portion and being parallel to the first line.

3. The grinder according to claim 1, wherein the engagement portion has a plurality of engagement elements which are respectively engageable with the attachment portion.

4. The grinder according to claim 3, wherein said plurality of engagement elements are arranged approximately symmetrically to each other with respect to the center of the attachment portion.

5. The grinder according to claim 3, wherein the wheel cover is selectively located at one rotational position from a plurality of rotational positions which are different to each other, and the wheel cover is attachable to the collar in a selectively provided rotational position, wherein the attachment portion has a plurality of attached portions which are engageable with the engagement portion respectively, said plurality of attached portions being spaced apart at a same interval in a circumference direction of the attachment portion, and wherein each engagement element engages with one of the attached portion from said plurality of attached portions in a selectively provided rotational position.

6. The grinder according to claim 3, further comprising a connecting portion which connects said plurality of engagement elements to each other, the connecting portion being contactable with the attachment portion, wherein the attachment portion is held by the collar and the connecting portion.

7. The grinder according to claim 1, wherein the engagement portion has a plurality of engagement elements which are respectively engageable with the attachment portion, and wherein at least one of the plurality of engagement elements is adapted to cancel an engagement with the attachment portion by moving to inside of the attachment portion, and another one of the plurality of engagement elements is adapted to cancel an engagement with the attachment portion by moving to outside of the attachment portion.

8. The grinder according to claim 1, wherein the engagement portion operating member is located at a tangent line region which corresponds to a tangent line parallel to the first line, and wherein the engagement portion operating member moves linearly along the tangent line.

9. The grinder according to claim 1, wherein the holding member has a biasing member which biases the engagement portion operating member, wherein the engagement portion operating member is adapted to cancel an engagement between the attachment portion and engagement portion by moving against a biasing force of the biasing member.

10. The grinder according to claim 1, wherein the holding member has a regulating portion which prevents a tilting movement of the wheel cover by engaging with the attachment portion.

11. The grinder according to claim 1, wherein the attachment portion has a plurality of engaged portions which are engageable with the engagement portion, wherein the grinder further comprises a first elastic member which is engageable with the engagement portion, the first elastic member biasing the attachment portion in a direction parallel to an axial direction of the attachment portion, wherein the attachment portion rotates against the collar in a circumference direction and contacts with the collar by means of a biasing force of the first elastic member.

12. The grinder according to claim 11, wherein the grinder further comprises a second elastic member which biases the attachment portion via the holding member in the direction parallel to the axial direction of the attachment portion, and wherein the attachment portion is adapted to contact with the collar by means of a biasing force of the second elastic member.

13. The grinder according to claim 12, wherein the first elastic member and the second elastic member are formed as a singular member.

14. The grinder according to claim 1, wherein a recess is provided on the collar, the recess extending along a circumference direction of the collar at a predetermined position in an axial direction of the collar, wherein the holding member is movable in a radial direction of the collar inside the recess, and is regulated to move in an axial direction of the collar by engaging with the recess.

15. The grinder according to claim 1, wherein the attachment portion has a plurality of attached portions which are engageable with the engagement portion respectively, each attached portion having two surfaces which face to each other and cross a direction in which the wheel cover rotates respectively, wherein the engagement portion has a tapered surface which inclines to at least one of the two surfaces.

16. The grinder according to claim 1, further comprising a first elastic member which biases the attachment portion in a direction parallel to an axial direction of the attachment portion, wherein the attachment portion rotates against the collar in a circumference direction and contacts with the collar by means of a biasing force of the first elastic member, wherein the first elastic member has a base portion and a biasing portion, the base portion being fixed on the body, the biasing portion biasing the attachment portion, and wherein the first elastic member is formed by a bent elastic plate such that a first surface of the base portion with which the body contacts and a second surface of the biasing portion with which the attachment portion contacts are connected to each other.

17. The grinder according to claim 16, wherein the first elastic member is made of a metal leaf spring.

18. A grinder comprising:

a body which has a collar;

a wheel cover which is attachable to the collar; and a holding member which is adapted to hold the wheel cover fixedly to the collar, wherein the wheel cover has an annular shaped attachment portion which is attachable to the collar, the holding member has an engagement portion and an engagement portion operating member to move the engagement portion, the engagement portion being engageable with the attachment portion, the engagement portion operating member switches a state between an engagement state in which the attachment portion and the engagement portion are engaged to each other and a disengagement state in which the attachment portion and the engagement portion are disengaged to each other by moving the engagement portion, the engagement portion operating member moves on a second line which is parallelly offset from a first line passing a center of the attachment portion and extending in a predetermined direction, the engagement portion has a plurality of engagement elements which are respectively engageable with the attachment portion, and at least one of the plurality of engagement elements is adapted to cancel an engagement with the attachment portion by moving to an inside of the attachment portion, and another one of the plurality of engagement elements is adapted to cancel an engagement with the attachment portion by moving to an outside of the attachment portion.

19. A grinder comprising:

a body which has a collar;

a wheel cover which is attachable to the collar; and a holding member which is adapted to hold the wheel cover fixedly to the collar, wherein the wheel cover has an annular shaped attachment portion which is attachable to the collar, the holding member has an engagement portion and an engagement portion operating member to move the engagement portion, the engagement portion being engageable with the attachment portion, the engagement portion operating member switches a state between (i) an engagement state in which the attachment portion and the engagement portion are engaged to each other, and (ii) a disengagement state in which the attachment portion and the engagement portion are disengaged to each other by moving the engagement portion, the engagement portion operating member is configured to slide linearly on a second line, which is offset in a radial direction of the annular shaped attachment portion from and parallel to a first line that extends diametrically across the annular shaped attachment portion, to switch the state, a recess is provided on the collar, the recess extending along a circumference direction of the collar at a predetermined position in an axial direction of the collar, the holding member has a flat portion which is movable inside the recess in a direction crossing the axial direction of the collar, the engagement portion is configured to move between (i) an engagement position corresponding to the engagement state in which the attachment portion and the engagement portion are engaged to each other and (ii) a disengagement position corresponding to the disengagement state in which the attachment portion and the engagement portion are disengaged from each other by moving a portion of the flat portion toward an inside of the recess in the direction crossing the axial direction of the collar, and the holding member is configured such that movement of the holding member in the axial direction of the collar is regulated by engaging the flat portion inside the recess and with the recess when the engagement portion is positioned at the engagement position and when the engagement portion is positioned at the disengagement position.

* * * * *